US012157987B2

(12) United States Patent
Hatanaka et al.

(10) Patent No.: US 12,157,987 B2
(45) **Date of Patent: *Dec. 3, 2024**

(54) ROTARY WORKING VEHICLE

(71) Applicant: YANMAR POWER TECHNOLOGY CO., LTD., Osaka (JP)

(72) Inventors: Mitsuyuki Hatanaka, Chikugo (JP); Takahiro Ikeda, Chikugo (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/563,396

(22) Filed: Dec. 28, 2021

(65) Prior Publication Data

US 2022/0136207 A1 May 5, 2022

Related U.S. Application Data

(63) Continuation of application No. 17/251,668, filed as application No. PCT/JP2019/022119 on Jun. 4, 2019, now Pat. No. 11,236,487.

(30) Foreign Application Priority Data

Jun. 21, 2018 (JP) ..... 2018-118026

(51) Int. Cl.
*E02F 9/12* (2006.01)
*E02F 9/22* (2006.01)
(Continued)

(52) U.S. Cl.
CPC ..... *E02F 9/123* (2013.01); *E02F 9/2271* (2013.01); *E02F 9/2275* (2013.01); *E02F 3/32* (2013.01); *E02F 3/382* (2013.01); *E02F 9/166* (2013.01)

(58) Field of Classification Search
CPC ..... E02F 9/123; E02F 9/2271; E02F 9/2275; E02F 3/32; E02F 3/382
See application file for complete search history.

(56) References Cited

U.S. PATENT DOCUMENTS 9,719,233 B1 8/2017 Abe
10,472,805 B1 * 11/2019 Kumeuchi ..... E02F 9/2095
(Continued)

FOREIGN PATENT DOCUMENTS

JP 1994/027956 U 4/1994
JP 11200409 A * 7/1999 ..... E02F 9/2271
(Continued)

OTHER PUBLICATIONS

International Search Report dated Aug. 20, 2019 issued in corresponding PCT Application PCT/JP2019/022119.

*Primary Examiner* — Gerald McClain
(74) *Attorney, Agent, or Firm* — NORTON ROSE FULBRIGHT US LLP

(57) ABSTRACT

A rotary working vehicle includes a lower traveling body, an upper rotating body, a rotating frame constituting the bottom of the upper rotating body, a boom bracket supported by the rotating frame so as to be capable pivoting horizontally, a first vertical plate and a second vertical plate, which are raised from the bottom plate of the rotating frame, a swing cylinder provided on the opposite side of the second vertical plate from the first vertical plate and connecting the rotating frame and the boom bracket, a protrusion piece protruding toward the swing cylinder from a side wall of the second vertical plate above the swing cylinder, a hose guide provided to the protrusion piece, and first and second hydraulic hoses which pass above the first vertical plate and the second vertical plate, extend downward from above through the hose guide, and reach the swing cylinder.

20 Claims, 6 Drawing Sheets

(51) Int. Cl.

| | |
|---|---|
| *E02F 3/32* | (2006.01) |
| *E02F 3/38* | (2006.01) |
| *E02F 9/16* | (2006.01) |

(56) References Cited

U.S. PATENT DOCUMENTS

| | | | | |
|---|---|---|---|---|
| 10,662,619 | B2 * | 5/2020 | Sakamoto | F15B 11/003 |
| 11,236,487 | B2 * | 2/2022 | Hatanaka | E02F 9/2275 |
| 2004/0187366 | A1 * | 9/2004 | Yoshida | E02F 9/2271 37/407 |

FOREIGN PATENT DOCUMENTS

| | | | | | |
|---|---|---|---|---|---|
| JP | 3377198 | B2 | | 2/2003 | |
| JP | 2013087423 | A | * | 5/2013 | A01G 23/08 |
| JP | 2014198934 | A | * | 10/2014 | |
| JP | 2014-214442 | A | | 11/2014 | |
| JP | 2017009081 | A | * | 1/2017 | E02F 3/325 |

* cited by examiner

ROTARY WORKING VEHICLE

CROSS REFERENCE TO RELATED APPLICATIONS

This application is a continuation of U.S. patent application Ser. No. 17/251,668 filed Dec. 11, 2020, which is a national stage application pursuant to 35 U.S.C. § 371 of International Pat. App. No. PCT/JP2019/022119 filed Jun. 4, 2019, which claims priority under 35 U.S.C. § 119 to JP Pat. App. No. 2018-118026 filed Jun. 21, 2018, the disclosures of each of which are hereby incorporated by reference in their entireties.

TECHNICAL FIELD

The present invention relates to a rotary working vehicle, for example, a rotary working vehicle including a swing function.

BACKGROUND ART

A rotary working vehicle such as a backhoe is equipped with a lower traveling body, an upper rotating body rotatably disposed above the lower traveling body, and a working machine supported rotatably in an up-down direction by a front portion of the upper rotating body.

JP Pat. No. 3377198 ("JP '198") describes a rotary working machine configured such that a rotating frame of an upper rotating body includes a bottom plate, left and right vertical plates extending in a front to back direction and disposed in a standing manner on the bottom plate, and a transverse plate inclined obliquely downward toward the front side with opposite ends firmly fixed to the left and right vertical plates, respectively, and such that a hose insertion hole into which a hydraulic hose extending toward a working machine is inserted is disposed above the transverse plate in at least one of the vertical plates.

Further, JP Unexamined Pat. App. Pub. No. 2013-87423 ("JP '423") describes a working machine configured such that at least one of vertical plates and a transverse plate of an upper frame (corresponding to a rotating frame) includes, at an upper edge thereof, a pair of protrusions, and such that a piping element (hydraulic hose or the like) is disposed between the pair of protrusions. In JP '423, the piping element is inserted into a through-hole of a grommet, and the grommet is fitted in between the pair of protrusions.

Incidentally, in order to enhance workability in a narrow space, a rotary working vehicle may be equipped with a so-called swing function allowing a base end portion of a working machine to horizontally rotate as well as allowing the working machine to rotate in an up-down direction. A hydraulic swing cylinder is disposed above a rotating frame in the rotary working vehicle equipped with the swing function. The swing cylinder is configured such that a cylinder tube is pivotally connected to the rotating frame and such that a cylinder rod is pivotally connected to the base end portion of the working machine. The swing cylinder is horizontally rotated to the rotating frame by telescopic movement of the cylinder rod.

A piping structure of the hydraulic hose described in JP '198 is suitable for arranging a hydraulic hose to be connected to a boom cylinder or an arm cylinder disposed on the upper side while not suitable for arranging a hydraulic hose to be connected to a swing cylinder disposed on the lower side.

Furthermore, in JP '423, since a hole diameter of the through-hole formed in the grommet is designed so as to conform to the piping element to be inserted without generating a gap, the piping element has difficulty sliding through the through-hole of the grommet. Therefore, the hydraulic hose inserted into the through-hole of the grommet cannot follow an actuator rotating to the rotating frame as the swing cylinder rotates to the rotating frame.

SUMMARY OF THE INVENTION

The present invention is made in view of the above circumstances, and an object of the present invention is to provide a rotary working vehicle including a swing function, the rotary working vehicle being configured such that a hydraulic hose connected to a swing cylinder can follow the swing of the swing cylinder.

A rotary working vehicle according to an aspect of the present invention includes: a lower traveling body; an upper rotating body rotatably disposed above the lower traveling body; a rotating frame configuring a bottom portion of the upper rotating body; a swing body horizontally rotatably supported by a front portion of the rotating frame; a working machine supported rotatably in an up-down direction by the swing body; a first vertical plate and a second vertical plate which are located at an interval in a left-right direction on a bottom plate of the rotating frame and disposed in a standing manner to extend in a front to back direction; a hydraulic swing cylinder disposed on an opposite side of the first vertical plate with the second vertical plate in between and configured to connect the rotating frame and the swing body; a protrusion piece protruding toward the swing cylinder from a side wall of the second vertical plate located above the swing cylinder; a hose guide disposed at the protrusion piece; and a hydraulic hose passing above the first vertical plate and the second vertical plate and extending downward from above through the hose guide to the swing cylinder.

In the rotary working vehicle according to an aspect of the present invention, the hose guide may include a recessed cutout portion formed by cutting out the protrusion piece and configured to accommodate the hydraulic hose, and a closure member configured to close an opening end of the recessed cutout portion.

Further, the rotary working vehicle according to an aspect of the present invention may include: a hydraulic oil tank disposed outward of the second vertical plate in the left-right direction; a bracket configured to fix a lower portion of the hydraulic oil tank to the protrusion piece; and a cutout portion cut out in the bracket to be located corresponding to the hose guide.

According to an aspect of the present invention, since the hose guide is disposed at the protrusion piece protruding from an upper portion of a side wall of the second vertical plate located adjacent to the swing cylinder, a plurality of hydraulic hoses leading to the swing cylinder can be consolidated near the swing cylinder, and the plurality of hydraulic hoses can be separately disposed again. Therefore, in a case where the swing cylinder swings in accordance with telescopic movement of the swing cylinder, the hydraulic hoses connected to the swing cylinder can follow the swing of the swing cylinder.

DESCRIPTION OF EMBODIMENTS

An embodiment of the present invention will be described with reference to the drawings.

Figure 1:
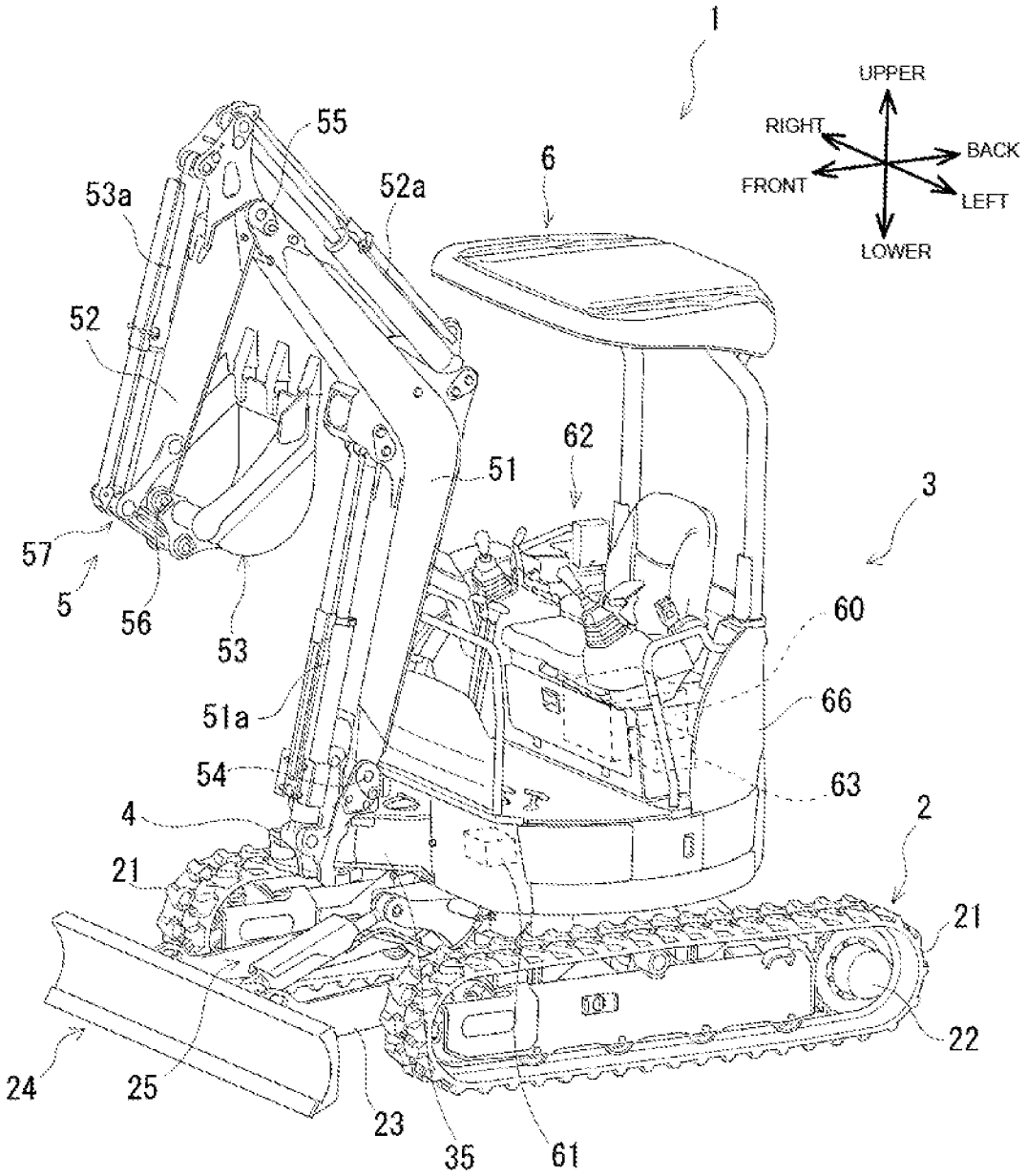
FIG. 1 is a perspective view illustrating an example of a rotary working vehicle according to an embodiment of the present invention.

As illustrated in FIG. 1, a rotary working vehicle 1 includes a lower traveling body 2, an upper rotating body 3 rotatably disposed above the lower traveling body 2, a boom bracket 4 as a swing body horizontally rotatably supported by the upper rotating body 3, and a working machine 5 supported rotatably in an up-down direction by the boom bracket 4. The rotary working vehicle 1 is configured as a shovel (backhoe) with a boom swing function. In general, the boom swing function is installed in a mini shovel that requires workability in a narrow space.

The lower traveling body 2 receives power from an engine 60 to be driven and thus allows the rotary working vehicle 1 to travel or rotate. The lower traveling body 2 includes a pair of left and right crawlers 21, 21 and a pair of left and right traveling motors 22, 22 configured to drive the crawlers 21, 21. A pair of blade arms 23, 23, a blade 24 as a soil removal plate extending in a left-right direction between end portions of the blade arms 23, 23, and a blade cylinder 25 configured to rotate the blade 24 in an up-down direction.

The upper rotating body 3 is configured to rotate around an axis extending in the up-down direction at the center thereof. The engine 60, a rotating motor 61, an operation unit 62, and the like are disposed on the upper rotating body 3. The operation unit 62 is equipped with an operator's seat and an operation device.

Figure 2:
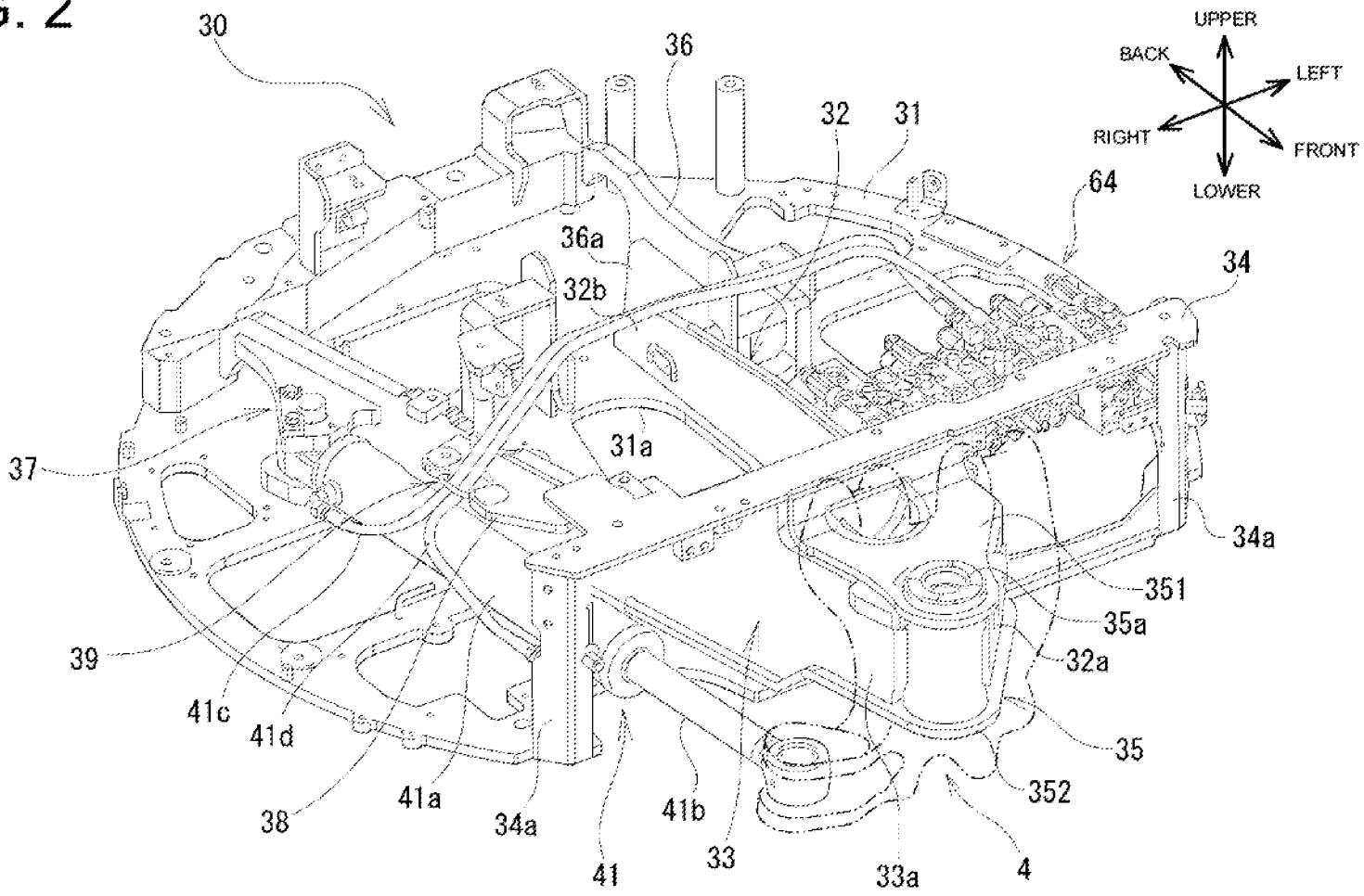
FIG. 2 is a perspective view of a rotating frame.
Figure 3:
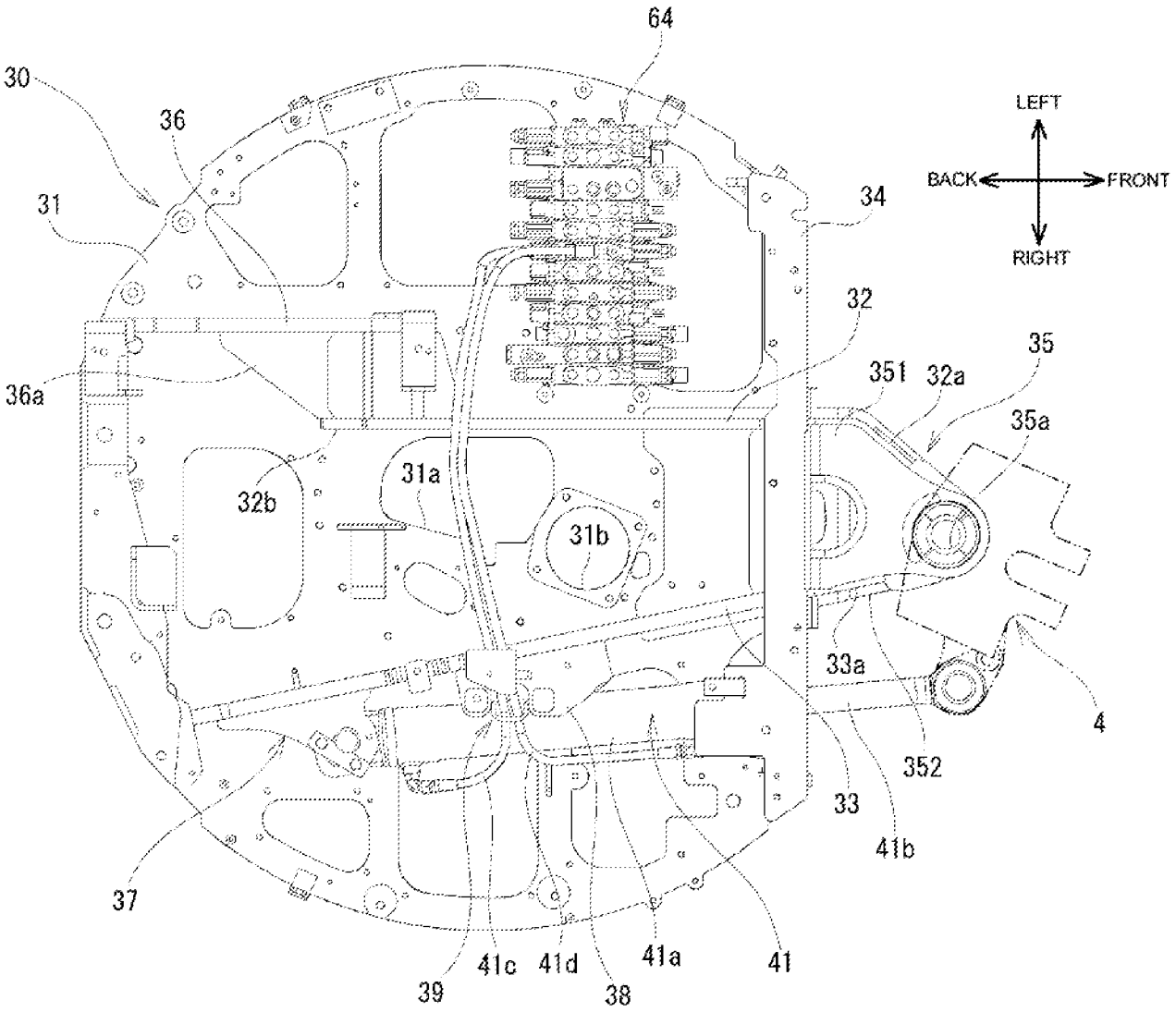
FIG. 3 is a plan view of the rotating frame.

The boom bracket 4 is attached via an attachment portion 35 to a front end portion of the upper rotating body 3. The boom bracket 4 is supported horizontally rotatably (i.e., swingably to the left and right) by the attachment portion 35. A swing cylinder 41 (see FIGS. 2 and 3) operable in a telescopic manner in a front to back direction is disposed between the upper rotating body 3 and the boom bracket 4. The boom bracket 4 is horizontally rotatably operated in accordance with the telescopic movement of the swing cylinder 41.

The working machine 5 receives power from the engine 60 to be driven and performs soil drilling operation or other operations in accordance with an operation at the operation unit 62. The working machine 5 is supported rotatably in the up-down direction by the boom bracket 4. The boom bracket 4 is provided with a pivotal pin 54 with the axis oriented in the horizontal direction. A base end portion (base end portion of a boom 51 described below) of the working machine 5 is supported so as to be rotatable in the up-down direction about the pivotal pin 54. In addition, the working machine 5 can swing in conjunction with the horizontal rotation of the boom bracket 4.

The working machine 5 includes the boom 51, an arm 52, and a bucket 53. The boom 51 is attached rotatably in the up-down direction to the boom bracket 4. The boom 51 extends in the up-down direction from the base end portion supported by the boom bracket 4 and is bent in a boomerang shape in a side view. A boom cylinder 51*a* movable in a telescopic manner is disposed between the boom bracket 4 and a middle portion of the boom 51. The boom 51 is rotated in the up-down direction to the boom bracket 4 in accordance with the telescopic movement of the boom cylinder 51*a*.

The arm 52 is attached rotatably in the up-down direction to the boom 51. A pivotal pin 55 with the axis oriented in the horizontal direction is disposed at a tip end portion of the boom 51. A base end portion of the arm 52 is supported rotatably in the up-down direction (rotatably in the front to back direction) about the pivotal pin 55. An arm cylinder 52*a* movable in a telescopic manner is disposed between the middle portion of the boom 51 and the base end portion of the arm 52. The arm 52 is rotated in the up-down direction to the boom 51 in accordance with the telescopic movement of the arm cylinder 52*a*.

The bucket 53 is attached rotatably in the up-down direction to the arm 52. A pivotal pin 56 with the axis oriented in the horizontal direction is disposed at a tip end portion of the arm 52. A base end portion of the bucket 53 is supported rotatably in the up-down direction (rotatably in the front to back direction) about the pivotal pin 56. A bucket link 57 is interposed between the tip end portion of the arm 52 and the bucket 53. The bucket link 57 is configured as a link that transmits drive force to the bucket 53. A bucket cylinder 53*a* movable in a telescopic manner is disposed between the bucket link 57 and the base end portion of the arm 52. The bucket 53 is rotated in the up-down direction to the arm 52 in accordance with the telescopic movement of the bucket cylinder 53*a*.

The upper rotating body 3 is configured such that the engine 60, a battery, a fuel tank, and the like are mounted on the rotating frame 30 and are covered by a bonnet 66, and the operation unit 62 is disposed at a front portion of the upper rotating body 3. A hydraulic pump 63 is connected to the engine 60. The hydraulic pump 63 is driven by the engine 60 to discharge hydraulic oil. The hydraulic oil discharged from the hydraulic pump 63 is supplied through a hydraulic hose, a control unit 64 described below, and the like to the swing cylinder 41, the boom cylinder 51*a*, the arm cylinder 52*a*, the bucket cylinder 53*a*, the blade cylinder 25, the traveling motors 22, 22, the rotating motor 61, and the like.

The rotating frame 30 includes a bottom plate 31 having a flat plate shape, a first vertical plate 32, and a second vertical plate 33. The rotating frame 30 also includes, above the bottom plate 31, an upper plate 34 to which a front end of the operation unit 62 is fixed. The upper plate 34 is fixed to upper ends of a pair of front support columns 34*a*, 34*a* disposed in a standing manner at a front end portion of the bottom plate 31.

The bottom plate 31 is formed such that the front end portion is cut out in the left-right direction into a circular shape in a plan view. The first vertical plate 32 and the second vertical plate 33 are located at an interval on the left and right sides on the bottom plate 31 and are formed in a standing manner so as to extend in the front to back direction. The first vertical plate 32 is disposed on the left side from the center of the rotating frame 30 in the left-right direction, and the second vertical plate 33 is disposed on the right side from the center of the rotating frame 30 in the left-right direction. A joint opening 31*a* for inserting a swivel joint and a motor opening 31*b* for attaching the rotating motor 61 are disposed between the first vertical plate 32 and the second vertical plate 33 in the bottom plate 31. A plurality of other openings for discharge and maintenance is also formed in the bottom plate 31.

The first vertical plate 32 and the second vertical plate 33 have lower edges thereof welded to an upper surface of the bottom plate 31. A front end portion 32*a* of the first vertical plate 32 and a front end portion 33*a* of the second vertical plate 33 protrude forward of the bottom plate 31 to configure a portion of the attachment portion 35. In addition, a rear end portion 32*b* of the first vertical plate 32 is connected via a connection portion 36*a* to a third vertical plate 36. The third vertical plate 36 is disposed in a standing manner so as to extend from a location near the center of the bottom plate 31 to a rear end portion of the bottom plate 31 in the front to back direction. The second vertical plate 33 extends to the rear end portion of the bottom plate 31.

The attachment portion 35 to which the boom bracket 4 is attached is disposed at a front end portion of the rotating frame 30 so as to protrude forward. The attachment portion 35 is formed in a taper shape in a plan view, and an insertion hole 35*a* for inserting a pivotal pin (not illustrated) is opened in the up-down direction at a front end portion of the attachment portion 35. The attachment portion 35 is provided with a pair of upper and lower stays 351, 352 disposed at an interval from each other. The upper stay 351 is attached to the upper plate 34 so as to protrude forward. The lower stay 352 is attached to the front upper surface of the bottom plate 31 so as to protrude forward from the front end portion of the bottom plate 31. The pair of stays 351, 352 sandwich the front end portion 32*a* of the first vertical plate 32 and the front end portion 33*a* of the second vertical plate 33 from above and below.

The control unit 64 is disposed on the left side of the first vertical plate 32. The control unit 64 is provided with control valves configured to control the operation of hydraulic cylinders (the swing cylinder 41, the boom cylinder 51*a*, the arm cylinder 52*a*, the bucket cylinder 53*a*, and the blade cylinder 25) and hydraulic motors (the traveling motors 22, 22 and the rotating motor 61). The control unit 64 includes at least a control valve configured to control the operation of the swing cylinder 41.

The swing cylinder 41 is disposed along the front to back direction on the right side of the second vertical plate 33. The swing cylinder 41 is configured such that a cylinder tube 41*a* is rotatably supported by a cylinder attachment portion 37 formed on the rotating frame 30 and such that a cylinder rod 41*b* is connected to the boom bracket 4 so as to be rotatable with the boom bracket 4. The cylinder rod 41*b* is moved in a telescopic manner, and thus the boom bracket 4 can rotate to the left and right. Along with this rotation, the swing cylinder 41 swings to the left and right about the cylinder attachment portion 37.

A protrusion piece 38 protruding to the right side (toward the swing cylinder 41) is disposed on an upper portion of a side wall of the second vertical plate 33. The protrusion piece 38 is located above the swing cylinder 41. The protrusion piece 38 is formed in a plate shape horizontally expanding. The protrusion piece 38 is welded to the second vertical plate 33.

A hose guide 39 is disposed at the protrusion piece 38. First and second hydraulic hoses 41*c*, 41*d* connecting the control unit 64 and the swing cylinder 41 are passed through the hose guide 39. The first and second hydraulic hoses 41*c*, 41*d* pass above the first vertical plate 32 and the second vertical plate 33 from the control unit 64 and extend downward from above through the hose guide 39 to the swing cylinder 41. Since the hose guide 39 is disposed such that a portion thereof is overlapped with the cylinder tube 41*a* of the swing cylinder 41 in a plan view (see FIG. 3), the first hydraulic hose 41*c* leading to the cylinder tube 41*a* and the second hydraulic hose 41*d* leading to the cylinder rod 41*b* can be consolidated near the swing cylinder 41, and the first and second hydraulic hoses 41*c*, 41*d* can be separately disposed again. Therefore, in a case where the swing cylinder 41 swings, the first and second hydraulic hoses 41*c*, 41*d* can follow the swing of the swing cylinder 41. In addition, the hose guide 39 is disposed at the protrusion piece 38, and thus it is not necessary that holes or the like for allowing passing of the hydraulic hoses are formed in the first vertical plate 32 and the second vertical plate 33. Consequently, no reinforcement needs to be added to the first vertical plate 32 and the second vertical plate 33.

Figure 4:
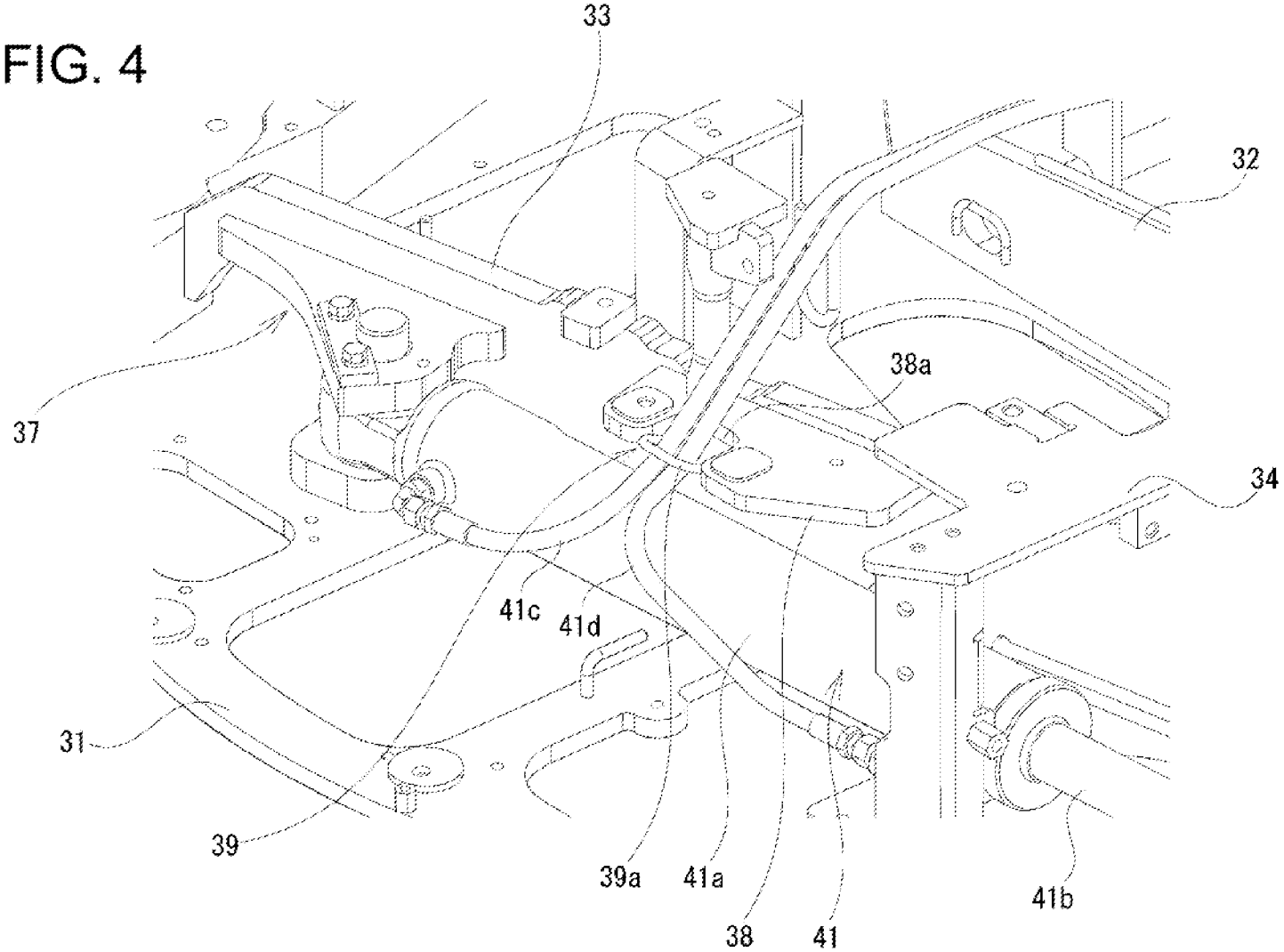
FIG. 4 is an enlarged perspective view of a hose guide.

FIG. 4 is an enlarged view of the hose guide 39. The hose guide 39 includes a recessed cutout portion 38*a* formed by cutting out a protruding end portion of the protrusion piece 38, and a closure member 39*a* configured to close an opening end of the recessed cutout portion 38*a*. The recessed cutout portion 38*a* is cut out into a substantially U-shape, and the first and second hydraulic hoses 41*c*, 41*d* can be accommodated in the recessed cutout portion 38*a*. The recessed cutout portion 38*a* is formed in a size allowing the first and second hydraulic hoses 41*c*, 41*d* to slide.

The closure member 39*a* is a member obtained by forming a metal round bar into a substantially U-shape. Opposite ends of the closure member 39*a* are fixed to the opening of the recessed cutout portion 38*a* by welding or another method. The closure member 39*a* is disposed such that the right side is located on the level higher than the left side. The closure member 39*a* prevents the first and second hydraulic hoses 41*c*, 41*d* from separating and detaching from the recessed cutout portion 38*a*. The closure member 39*a* is formed of the round bar; therefore, even when the first and second hydraulic hoses 41*c*, 41*d* make contact with or slide on the closure member 39*a*, the closure member 39*a* is not likely to be damaged.

Figure 5:
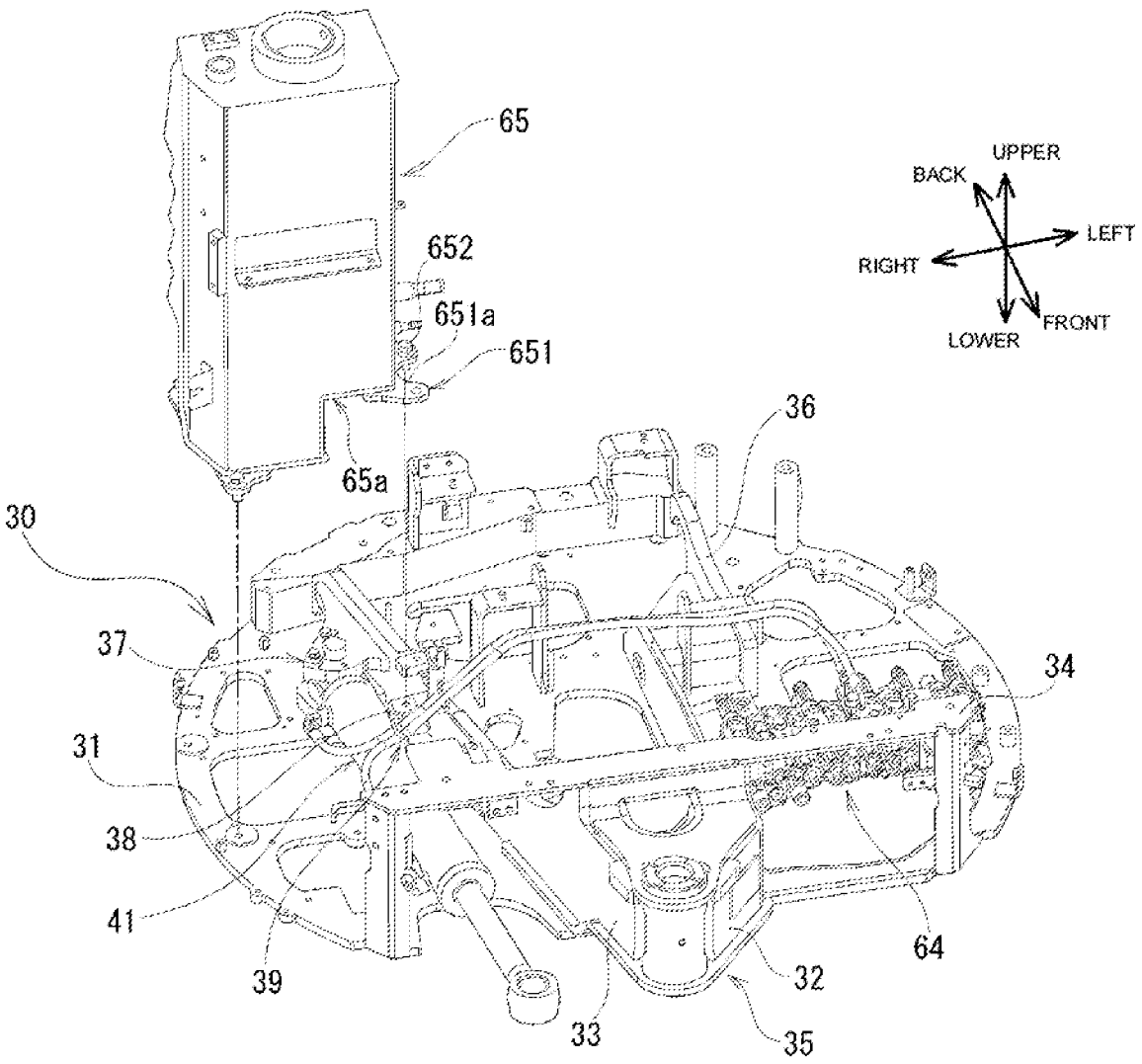
FIG. 5 is an exploded perspective view of the rotating frame and a hydraulic oil tank.
Figure 6:
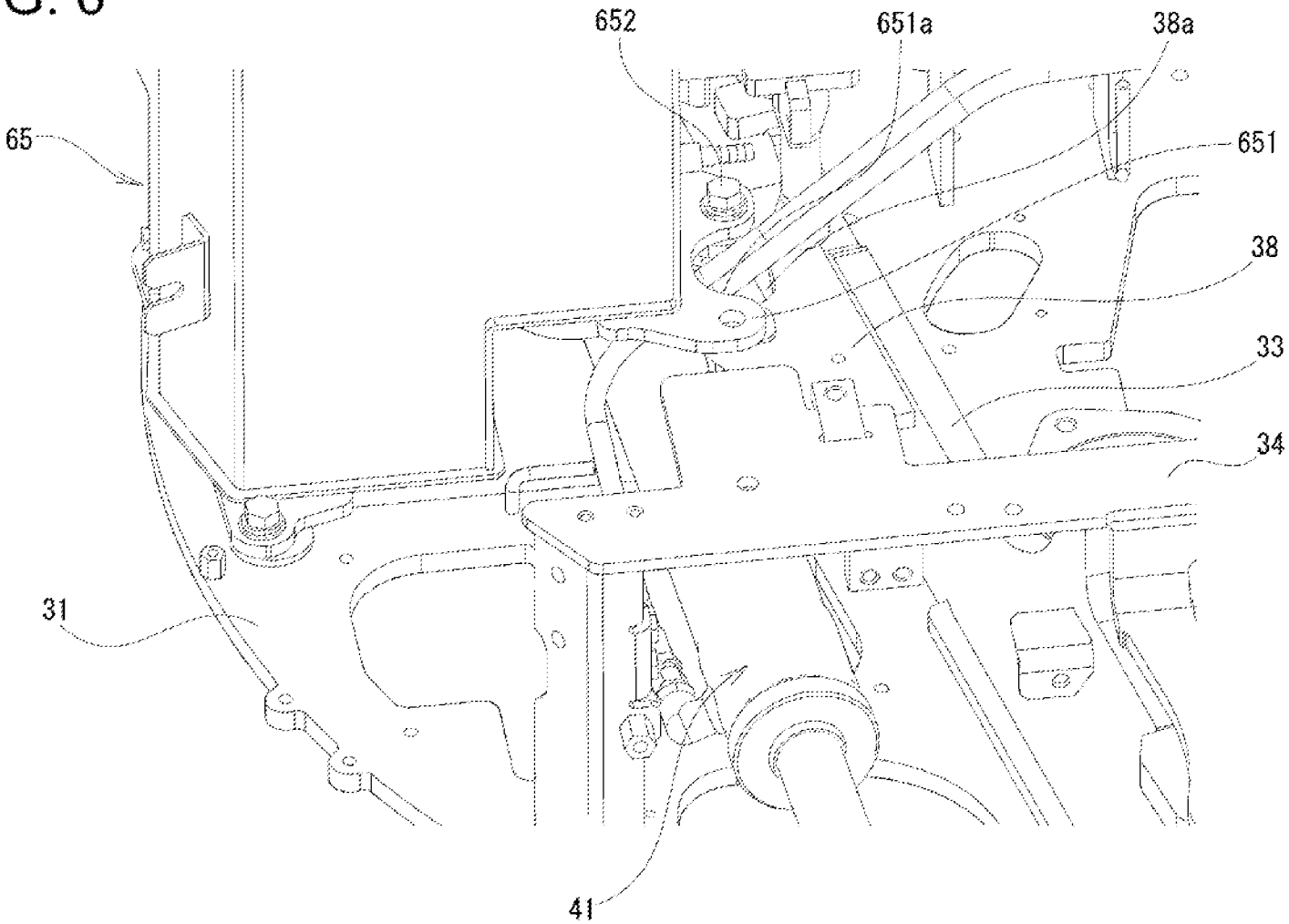
FIG. 6 is an enlarged perspective view of a mounting location of the hydraulic oil tank.

As illustrated in FIG. 5, a hydraulic oil tank 65 is disposed on the right side of the second vertical plate 33. The hydraulic oil tank 65 stores the hydraulic oil of the hydraulic pump 63. The hydraulic oil tank 65 is connected by a hydraulic hose (not illustrated) to the hydraulic pump 63. The hydraulic oil tank 65 is disposed on the center in the front to back direction at a right end portion of the rotating frame 30. A lower end portion of the hydraulic oil tank 65 is fixed to the bottom plate 31.

The hydraulic oil tank 65 is disposed so as to be overlapped with the swing cylinder 41 in a plan view. A recessed portion 65*a* extending in the front to back direction is formed at a left lower portion of the hydraulic oil tank 65 so as not to interfere with the swing cylinder 41. The recessed portion 65*a* of the hydraulic oil tank 65 is fixed via a bracket 651 to the protrusion piece 38. The bracket 651 has one end portion fixed to the recessed portion 65*a* and the other end portion extending beyond a left end portion of the hydraulic oil tank 65.

A cutout portion 651*a* cut out into a substantially U-shape is formed at a left end portion of the bracket 651. The cutout portion 651*a* is disposed at a position corresponding to the hose guide 39, that is, a position corresponding to the recessed cutout portion 38*a* of the protrusion piece 38 when the bracket 651 is fixed to the protrusion piece 38 with a bolt 652. Thus, the first and second hydraulic hoses 41*c*, 41*d* can be stably disposed along the cutout portion 651*a* of the bracket 651 of the hydraulic oil tank 65 by the hose guide 39. Consequently, a space in the bonnet 66 can be effectively used. In addition, the first and second hydraulic hoses 41*c*, 41*d* are disposed to extend through the hose guide 39 and along the cutout portion 651*a* of the bracket 651 of the hydraulic oil tank 65. Accordingly, even in a configuration where the hydraulic oil tank 65 is installed near the first and second hydraulic hoses 41*c*, 41*d*, other components can be easily assembled after the hoses are attached.

The present invention is not limited to the aforementioned embodiment, and various improvements and modifications can be made without departing from the spirit of the present invention.

DESCRIPTION OF REFERENCE NUMERALS

1 Rotary working vehicle
2 Lower traveling body
3 Upper rotating body
4 Boom bracket
5 Working machine
30 Rotating frame
31 Bottom plate
32 First vertical plate
33 Second vertical plate
35 Attachment portion
38 Protrusion piece
38a Recessed cutout portion
39 Hose guide
39a Closure member
41 Swing cylinder
41c First hydraulic hose
41d Second hydraulic hose
63 Hydraulic pump
65 Hydraulic oil tank
651 Bracket
651a Cutout portion

The invention claimed is:

1. A rotary working vehicle, comprising:

a lower traveling body;

an upper rotating body disposed above the lower traveling body and rotatable about an axis, the upper rotating body including a rotating frame;

a swing body horizontally rotatably supported by a front portion of the rotating frame;

a working machine supported rotatably in an up-down direction by the swing body;

a hydraulic swing cylinder configured to connect the rotating frame and the swing body, the hydraulic swing cylinder is configured to be supplied with oil from a hydraulic pump via a control unit; and a hydraulic hose extending from the control unit to the hydraulic swing cylinder and through a hose guide disposed within the upper rotating body.

2. The rotary working vehicle according to claim 1, wherein:

the hydraulic hose comprises:

a first hydraulic hose extending from the control unit to a cylinder tube side of the hydraulic swing cylinder; and a second hydraulic hose extending from the control unit to a cylinder rod side of the hydraulic swing cylinder, and the hose guide is configured to guide the first hydraulic hose and the second hydraulic hose.

3. The rotary working vehicle according to claim 2, wherein:

a first vertical plate and a second vertical plate are located at an interval in a left-right direction on a bottom plate of the rotating frame and disposed in a standing manner to extend in a front to back direction; and the first hydraulic hose and the second hydraulic hose are arranged above the first vertical plate and the second vertical plate.

4. The rotary working vehicle according to claim 3, wherein the hose guide is disposed on a side wall of the second vertical plate.

5. The rotary working vehicle according to claim 2, wherein the first hydraulic hose extends from the hose guide in a first direction, the second hydraulic hose extends from the hose guide in a second direction, and the first direction is opposite the second direction.

6. The rotary working vehicle according to claim 1, wherein the hose guide is disposed on a side wall of a second vertical plate.

7. The rotary working vehicle according to claim 1, wherein the hydraulic swing cylinder includes a cylinder tube and a cylinder rod.

8. The rotary working vehicle according to claim 7, wherein the hose guide is disposed above the hydraulic swing cylinder between a first end of the cylinder tube and a second end of the cylinder tube.

9. The rotary working vehicle according to claim 1, wherein the hydraulic swing cylinder includes a cylinder rod and is pivotably coupled to the swing body via the cylinder rod.

10. The rotary working vehicle according to claim 1, wherein the hydraulic swing cylinder includes a cylinder tube end and a cylinder rod end, the cylinder rod end positioned between the cylinder tube end and the swing body.

11. The rotary working vehicle according to claim 1, wherein an entirety of a cylinder tube of the hydraulic swing cylinder is positioned within the upper rotating body.

12. The rotary working vehicle according to claim 1, wherein the hydraulic hose extends from the hose guide toward the swing body and is coupled to a port of the hydraulic swing cylinder, wherein a plane that extends through a portion of the hose guide and through a portion of the hydraulic swing cylinder is co-planar with the axis about which the upper rotating body rotates.

13. The rotary working vehicle according to claim 1, wherein at least a portion of the hose guide is disposed directly above the hydraulic swing cylinder when the rotary working vehicle is in an orientation for operation on a horizontal surface.

14. The rotary working vehicle according to claim 1, wherein an entirety of the hydraulic hose is positioned directly above a bottom plate of the rotating frame.

15. The rotary working vehicle according to claim 1, wherein the hydraulic swing cylinder is coupled to the rotating frame via a cylinder tube end of the hydraulic swing cylinder.

16. The rotary working vehicle according to claim 1, wherein:

the hydraulic hose comprises:

a first hydraulic hose extends from the hose guide to a first port positioned at a cylinder tube side of the hydraulic swing cylinder; and a second hydraulic hose extends from the hose guide to a second port positioned at a cylinder rod side of the hydraulic swing cylinder.

17. The rotary working vehicle according to claim 16, wherein:

the first hydraulic hose extends from the hose guide toward the first port such that the first hydraulic hose extends away from the second port; and the second hydraulic hose extends from the hose guide toward the second port such that the second hydraulic hose extends away from the first port.

18. The rotary working vehicle according to claim 1, wherein the hydraulic hose, from the hose guide, branches to a first side of the hydraulic swing cylinder and to a second side of the hydraulic swing cylinder.

19. The rotary working vehicle according to claim 1, wherein the rotating frame includes a first plate coupled to a second plate, and wherein the hose guide is disposed between the first and second plates.

20. The rotary working vehicle according to claim 1, wherein the upper rotating body is a distinct component from the swing body, the working machine, the hydraulic swing cylinder, and the hydraulic hose, such that the swing body is external to the upper rotating body.

* * * * *